US010436007B2

(12) United States Patent
Deleersnyder et al.

(10) Patent No.: US 10,436,007 B2
(45) Date of Patent: Oct. 8, 2019

(54) DEVICE FOR DISCHARGING LIQUIDS ACCUMULATED IN A WELL

(71) Applicant: TOTAL SA, Courbevoie (FR)

(72) Inventors: Matthieu Deleersnyder, Pau (FR); Pierre Lemetayer, Pau (FR); Jean-Louis Beauquin, Saint-faust (FR)

(73) Assignee: TOTAL SA, Courbevoie (FR)

( * ) Notice: Subject to any disclaimer, the term of this patent is extended or adjusted under 35 U.S.C. 154(b) by 161 days.

(21) Appl. No.: 15/538,918

(22) PCT Filed: Dec. 22, 2014

(86) PCT No.: PCT/FR2014/053521
§ 371 (c)(1),
(2) Date: Jun. 22, 2017

(87) PCT Pub. No.: WO2016/102783
PCT Pub. Date: Jun. 30, 2016

(65) Prior Publication Data

US 2018/0010436 A1 Jan. 11, 2018

(51) Int. Cl.
*E21B 43/38* (2006.01)
*E21B 43/12* (2006.01)
(Continued)

(52) U.S. Cl.
CPC ..... *E21B 43/38* (2013.01); *E21B 17/18* (2013.01); *E21B 43/122* (2013.01); *E21B 43/123* (2013.01); *E21B 43/305* (2013.01)

(58) Field of Classification Search
CPC ..... E21B 43/38; E21B 43/123; E21B 17/18; E21B 43/122; E21B 43/305
See application file for complete search history.

(56) References Cited

U.S. PATENT DOCUMENTS 4,708,595 A 11/1987 Maloney et al.
6,039,121 A 3/2000 Kisman
(Continued)

FOREIGN PATENT DOCUMENTS

WO WO 2011/008522 A2 1/2011

OTHER PUBLICATIONS

International Search Report PCT/FR2014/053521, dated Sep. 9, 2015, 3 pages.
(Continued)

*Primary Examiner* — Brad Harcourt
(74) *Attorney, Agent, or Firm* — Patterson Thuente Pedersen, P.A.

(57) ABSTRACT

The present invention relates to a liquid evacuation device for an extraction well. The device comprises a tank presenting a liquid accumulation area. The tank is connected to a gas evacuation tubing. An insulant limits a flow of fluid between a wall of the tank and a wall of the well, from a first space formed between the insulant and the well bottom to a second space formed between the insulant and the well head. A first opening on the tank enables circulation of a gas-liquid mixture from said first space to a third space formed in the gas evacuation tubing. A second opening on the tank enables circulation of fluid from said second space to the liquid accumulation area. The first opening is made between the liquid accumulation area and the connection to the evacuation tubing.

12 Claims, 4 Drawing Sheets

(51) Int. Cl.
*E21B 43/30* (2006.01)
*E21B 17/18* (2006.01)

(56) References Cited

U.S. PATENT DOCUMENTS

| | | | | |
|---|---|---|---|---|
| 2010/0051288 | A1 | 3/2010 | Gaudette | |
| 2015/0034325 | A1* | 2/2015 | Tolman | E21B 43/12 166/313 |
| 2015/0247390 | A1* | 9/2015 | Mazzanti | E21B 17/18 166/372 |

OTHER PUBLICATIONS

English translation of International Search Report PCT/FR2014/053521, dated Sep. 9, 2015, 2 pages.

* cited by examiner

DEVICE FOR DISCHARGING LIQUIDS ACCUMULATED IN A WELL

RELATED APPLICATIONS

The present application is a National Phase entry of PCT Application No. PCT/FR2014/053521, filed Dec. 22, 2014, said application being hereby incorporated by reference herein in its entirety.

FIELD OF THE INVENTION

The present invention relates to the domain of extracting liquids present in bore holes. In particular, the present invention especially relates to an accumulation device enabling extraction of liquids in bore holes for the production of gas, oil or petroleum from unconventional resources or end-of-life wells.

BACKGROUND OF THE INVENTION

Unconventional resources are resources whose exploitation requires a higher-than-average level of technology or investment.

The three largest types of unconventional gas resources are tight sands, coal bed methane and shale gas.

Although these natural gas resources have historically been ignored in favor of conventional reserves, interest in these unconventional resources has grown in the last few years.

Nevertheless, in the context of wells exploiting these unconventional resources and/or in the context of non-vertical bore holes, liquid infiltration and stagnation may pose problems. In fact, the presence of these liquids significantly diminishes the yields of these wells.

Thus, a need exists for evacuating these liquids.

Methods enabling the evacuation of fluids (water, petroleum or a mixture of both) from the bottom of a well are designated by the generic term "artificial lift." All of these methods are based on the same principle: If the energy contained in the tank is insufficient for lifting fluids without assistance, then it is useful to artificially lower the hydrostatic pressure or reduce the inner diameter of the well.

These methods include:

1) The "gas lift" method: Gas is continuously injected into the hydrostatic column, this lightens the column and enables fluid to lift. Having gas and compressors available at the surface is useful. When the oil/water proportion varies over time and as the tank pressure continues to reduce, then the gas injection point should be modified several times by means of well servicing. The "gas lift" method can be used in many situations (for ex., with a flow rate of 4,800 $m^3$/day or with a drill depth of 4,600 m).
2) Methods using ESP (Electric Submersible Pump) pumps: These ESP pumps are positioned at the bottom of the well, within the liquid to be pumped. They create a depression in the well and a suction effect. These pumps require heavy and expensive equipment to be put in place and must be supplied with electricity from the surface. Possible flow rates can be varied (for ex., from tens of cubic meters per day to tens of thousands of cubic meters per day). Nevertheless, these pumps may not be primed if gas enters into the system (i.e., "gas lock") and consequently, the evacuation of liquid will be compromised. These pumps are very prone to erosion and do not operate well if a gaseous fluid is present in the fluid, causing, for example, cavitation.
3) Methods using PCP (Progressive Cavity Pump) pumps: These pumps consist of a stator and a rotor. These pumps are positioned at the bottom of the well, within the liquid to be pumped, and must be supplied with electricity from the surface. Although these methods can be flexible, they do not enable all possible flow rates to be reached (up to 600 $m^3$/day). In addition, the installation depths are limited (approximately 1,800 m). These pumps are very resistant to erosion and to the presence of solids, but certain aromatic compounds contained in hydrocarbons can damage the elastomer of the stator. In addition, these pumps are difficult to operate under polyphasic flow conditions.
4) Methods using "beam pumps." Beam pumps are surface pumps that lift fluids in a cylinder from the well bottom. These methods are limited to low-yield wells (5 to 40 liters at each movement), and can be locked by the gas lock phenomenon (if gas enters into the system, no or little liquid can be lifted, because gas is compressible, unlike liquid). Power is required at the surface to operate the pump. In addition, these pumps are difficult to operate in inclined or horizontal wells.
5) Injection of surfactants at the well bottom that mix with liquid and form a foam, thereby lowering the hydrostatic pressure.
6) Installation of small-diameter tubing into the well (for ex. "velocity string" or "capillary string"): This tubing increases the velocity of the gas rising to the surface and, consequently, its liquid driving power. Installing this tubing requires that the full well completion design be overhauled (a potentially major operation). In addition, this installation cannot be a long-term solution, because as the tank pressure lowers, even a small diameter can be insufficient to create a sufficient velocity to evacuate liquids.

Such methods are not free from faults, as indicated previously.

In addition, whereas historically gas wells were vertical, the development of unconventional resources was only made possible by drilling inclined or horizontal wells.

All the methods previously presented, if they are applicable to vertical wells, cannot be easily applicable to inclined or horizontal wells. In particular, methods comprising pumps activated by rods placed under rotation or traction from the surface can be difficult to implement in deviated wells.

Therefore a need exists for a method to evacuate liquids in wells that is inexpensive, simple to implement and strong.

SUMMARY OF THE INVENTION

The present invention attempts to improve the situation. Therefore the present invention relates to a liquid evacuation device capable of being positioned in an extraction well, the well comprising a well head and a well bottom. The device comprises:

- a tank presenting a liquid accumulation area, said tank being able to be connected to gas evacuation tubing positioned in the extraction well;
- an insulant able to limit a flow of fluid between a wall of the tank and a wall of the well, from a first space formed between the insulant and the well bottom to a second space formed between the insulant and the well head;

a first opening made on said tank enabling circulation of a gas-liquid mixture from said first space to a third space formed in the gas evacuation tubing;

a second opening on said tank enabling circulation of fluid from said second space to the liquid accumulation area.

Said first opening is made between the liquid accumulation area and the connection to the evacuation tubing.

Unlike devices from the prior art, the first opening is not situated at the bottom of the tank (i.e., the accumulation area). The tank in the accumulation area can be sealed, without any valve, for example. In fact, in the event of a low opening at the tank bottom, effluents from the production area must pass through the fluid accumulated in the tank installed in the well. The tank then serves as both a transit area for fluids from the bottom to the surface and as an accumulation area. Here these two functions are separated. Liquids that accumulate in the tank no longer restrict the circulation of effluents produced.

Such a device has many advantages, such as not being affected by the path of the well or by the presence of gas and liquid. In addition, this device lowers the minimum operating pressure of the well and thus delays well abandonment. Compared to conventional effluent lifting techniques using gas injection, or gas lift, this device reduces the gas necessary for evacuating liquids due to, for example, intermittent operation and lifting a large volume of liquid during each cycle. It is also less disadvantageous to well production, due to optimized fluid circulation and storage in wells and from wells to the surface.

The system presents a modularity enabling the system to be adapted to well conditions. First, the tank bottom (i.e., the area closest to the bottom of the well) may be shaped to be initially open in order to allow the well to operate conventionally (eruptive mode). Closing the tank bottom for operation as described below can be considered when conventional well exploitation no longer enables a sufficient economic performance. Thus the device can be used in several ways and therefore is adapted to real well conditions.

Gas injection valves situated in the evacuation tubing can also be used if needed (well clearing, lift assist of liquids if produced in large quantities, for example).

In addition, the gas injection tubing can be installed later.

Of course, it is possible that the tank is formed by tubing that is similar to the gas/effluents evacuation tubing mentioned above. This similar tubing is simply closed at its lower end.

In the context of this invention, the size of the evacuation tubing does not have to be particularly reduced, in advance, to have flow speeds enabling good liquid lifting by gas. A large diameter may also present several advantages during the life of the well. First (before the device that is the object of this invention is used), a large diameter can avoid an important restriction to production, during the period when the well is capable of producing alone. Then, when the device is used, a large diameter can be more favorable to gas and liquid separation.

The device can be arranged to enable circulation of a liquid from said gas-liquid mixture from said third space to the liquid accumulation area.

Thus, circulation inside the evacuation tubing to the accumulation area can be done by simple gravity.

Effluents (gas-liquid mixture) from the production area can enter into the device by the first opening. The layout of the device can make liquids from said gas-liquid mixture, due to gravity, accumulate in the tank, either directly from their entrance into the device or after having started rising in the evacuation tubing and falling back into the tank by counter-flow.

This gas-liquid separation may facilitate gas lift (reduced hydrostatic column).

Different means of improving this separation and carrying it out in a localized manner can be added to the base system to improve overall efficiency: Cyclonic separation, direction of flow from the first opening to the bottom, etc., are possible examples of layouts aiming to improve separation.

A first injection tubing can be connected to the second opening for gas injection directed to an end of the accumulation area, this end being opposite in the well from the connection to the evacuation tubing.

This first tubing may thus enable high-velocity fluid to be injected to the bottom of the fluid accumulation area to purge (at least partially) the tank of any liquid.

It is also possible that this tubing is directly surface-connected, without this tubing having an opening in the evacuation tubing (for example, in the case of tubingless wells without extraction tubing).

A non-return device may be disposed in the first injection tubing if necessary. In a preferential layout, this valve can be situated at the second opening.

This layout presents the benefit of maximizing the volume that can be used to store liquids. In fact, a valve situated at the end of the first injection tubing (therefore close to the well bottom) may limit the volume at the annular space between the first injection tubing and the tank wall.

In order to benefit from this storage capacity, it may be advantageous to place a spill point (small-diameter calibrated orifice) downstream from the non-return valve so that the gas trapped downstream from the valve, in the first injection tubing, can escape when the tank and first injection tubing are filled.

A second injection tubing can be connected to the first opening for directed injection of the gas-liquid mixture to the inside of the connected evacuation tubing.

This second tubing enables the direction of the mixture to be controlled (for example, towards the top, towards the center of the evacuation tubing section) to control the aerodynamic effects on the mixture (particularly effects enabling improved liquid and gas separation from this mixture).

A non-return device may be disposed on the second injection tubing to limit the circulation of at least one liquid towards the first space. This non-return device may also be disposed at the first opening to prevent the circulation of effluents/liquids from the tank to the first space.

In addition, installing a separator either on this tubing or in the gas evacuation tubing is possible to promote separation of the liquid from the liquid-gas mixture. This separator may be a cyclonic separator.

At least one part of the tank may be extractable through the inside of the connected gas evacuation tubing, said at least one extractable part may comprise the first opening and the second opening.

In addition, said at least one extractable part may also comprise non-return valves, a tank bottom cap and injection tubing.

This tank part may be removable to facilitate maintenance of the device. In fact, the pieces of the device stressed during device operation (and therefore likely to fail or break) are in an area close to two openings such as valves or injection tubing, if applicable.

Advantageously, the tank may comprise a horizontal sub-part.

As detailed below, it may be useful that the tank part containing the accumulation area finds its greatest length horizontally. In fact, this horizontality enables the accumulation capacity of the accumulation area to be substantially increased without increasing the height (according to the gravity axis) of the device (i.e., without increasing the resistance, or hydrostatic weight, that the gas sustains as the liquid rises to the top of the tank).

In one embodiment, the length of a bottom of said tank at the first opening may be over twice the height according to a gravity axis between said tank bottom and the first opening.

For example, the position of the first opening may be positioned higher (according to the vertical axis) than the highest point of the tank (which may correspond to the horizontal or deviated section of the well) to ensure correct filling of this accumulation area.

The present invention also relates to a method for evacuating liquid from an extraction well, the well comprising a well head and a well bottom.

The well comprises:

- a tank presenting a liquid accumulation area, and gas evacuation tubing connected to the tank;
- an insulant limiting a flow of fluid between a wall of the tank and a wall of the well, from a first space formed between the insulant and the well bottom to a second space formed between the insulant and the well head;

The method comprises:

- circulating of a gas-liquid mixture through a first opening made in said tank, the circulation of said mixture being done from said first space to a third space formed in the gas evacuation tubing, the first opening being made between the liquid accumulation area and the connection to the evacuation tubing;
- separating, at least partial, of a liquid from said mixture in said gas evacuation tubing;
- displacing of said separated liquid using gravitational force towards the liquid accumulation area;
- injecting of fluid through a second opening in said tank from said second space to the liquid accumulation area, said injection being capable of evacuating at least part of the liquid accumulated in the accumulation area via the evacuation tubing.

Injection of fluid through a second opening can be carried out upon detection of a drop in pressure or flow in the gas evacuation tubing.

This pressure or flow drop (advantageously measured at the well head) may be detected by using a derivative of the pressure or flow curve: In this case, the absolute value of the derivative calculated will be greater than a certain value.

The gas injection may be stopped upon detection of lower pressure/flow of liquids at the well head, for example. The volume of liquid produced may be another indicator. During each cycle, it is possible to empty the accumulation area of a finite and known volume. It is therefore possible to stop the injection of gas used for emptying when a volume equal to the volume of the chamber is produced.

Injection of fluid through a second opening can be carried out upon detection of pressure in the gas evacuation tubing below a predetermined pressure.

The pressure in the evacuation tubing may advantageously be measured at the well head.

Other characteristics and advantages of the invention will appear upon reading the following description. The description is purely illustrative and should be read in conjunction with the appended drawings, in which:

BRIEF DESCRIPTION OF THE FIGURES

FIG. 1*a* illustrates a particular realization of the liquid accumulation and extraction device in a particular embodiment of the invention.

Figure 1A:
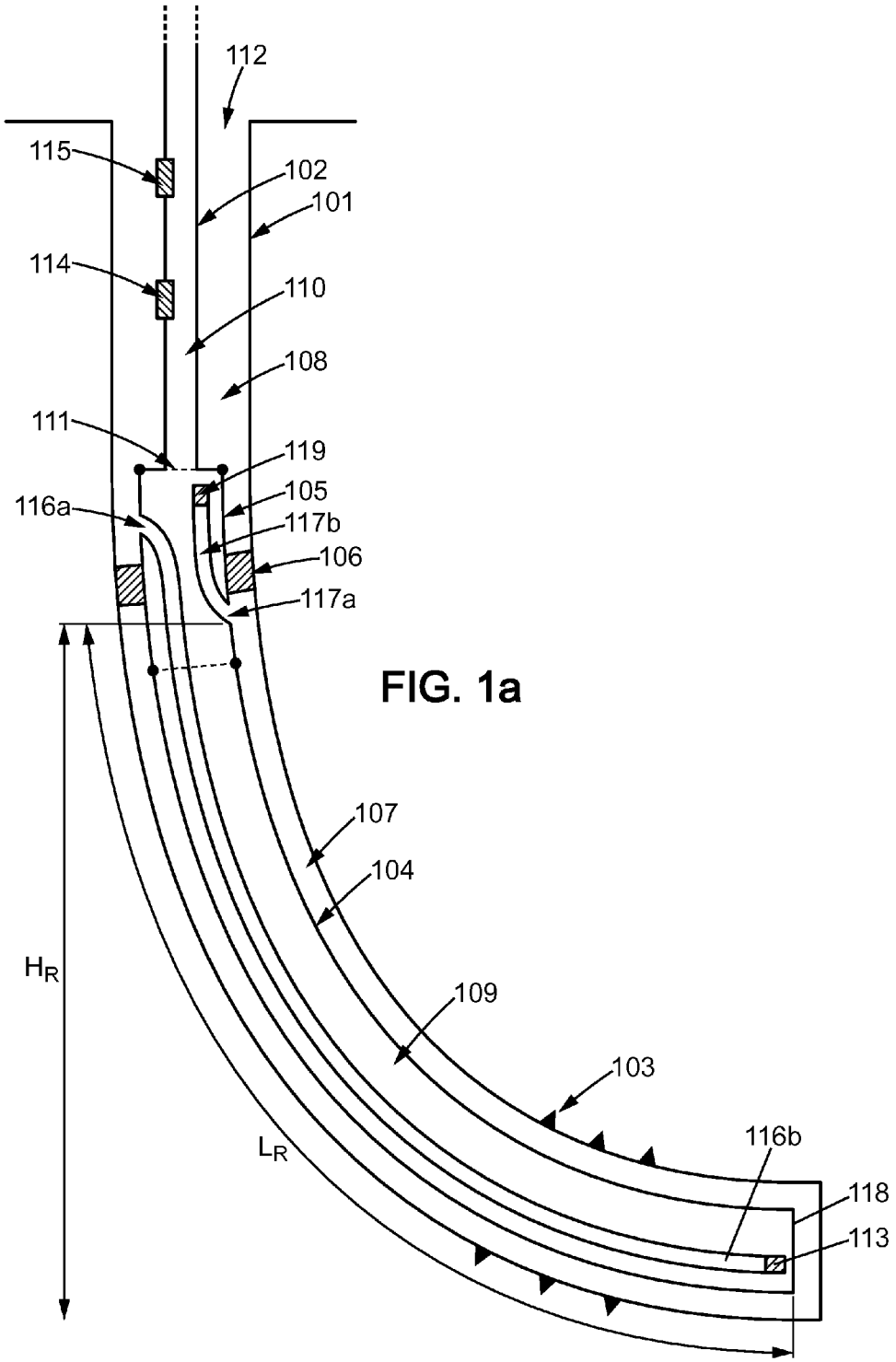
FIGS. 1*a* and 1*b* illustrate particular realizations of the liquid accumulation and extraction device in two particular embodiments of the invention.

The evacuation device of FIG. 1 is positioned in a pre-drilled extraction well 112. Most often, the walls of this well 101 are reinforced using metal or concrete structures, or casings.

In particular, for reasons of safety and/or operation, tubing 102 is inserted into this well to evacuate the production fluids (for ex., hydrocarbon or gas).

At the level of the underground hydrocarbon reserve (geological formations containing liquid/gaseous hydrocarbons), walls 101 of the well are pierced/perforated (see completion 103) to allow the fluid of interest to penetrate into the wall and thus facilitate its extraction. It is assumed in the following that this fluid of interest is a gas, but this fluid of interest may very well apply to other fluids, including liquids.

A "well head" is the area of the ground at the level of which the wall was drilled. A "well bottom" is a lower end of the well or the part that is farthest from the well head (often single, except in the event of bifurcation in the well).

In well 112, it is possible to connect an accumulation tank (104 and 105) to the evacuation tubing 102. This tank comprises a sub-part 104 comprising a liquid accumulation area 109. Advantageously, this sub-part 104 extends along the well to the bottom of the well in order to have the largest possible volume within accumulation area 109. In addition, the walls of the accumulation area (or the walls of the tank) are close to the wall 101 of the well. In fact, increasing the flow velocity of the production gas in the annular area (i.e., between the wall of the well and the wall of the tank) is useful to promote the effect of entrainment of liquids present at the well bottom by the production gas. For example, the distance between wall 101 and the wall of accumulation area 104 may correspond to 10% of the well diameter.

Advantageously, sub-part 105 of the tank can be detached from evacuation tubing 102 and sub-part 104 of the tank comprising accumulation area 109. This detachment may be carried out even while the collection and extraction device of the invention is in place in the well, thanks to tools lowered into evacuation tubing 102. Once detached, this part can be raised within evacuation tubing 102.

It is also possible to fix an insulant, or packer, 106 to the tank 105 enabling any flow of fluid between the wall of the tank (105 or 104) and the wall of well 101 to be limited.

This flow limitation can be complete or partial (for ex., presence of a valve on the insulant).

Thus the insulant defines two annular spaces in the well: A first space 107 formed between insulant 106 and the well bottom 118 and a second space 108 formed between insulant 106 and the well head.

In the extractable sub-part 105 (or upper part of the tank), it is possible to provide a first opening 117*a* to enable circulation of the mixture formed by the production gas and liquids from annular space 107 to the inside of the tank (105, 104) or to the inside 110 of evacuation tubing 102 connected to the tank.

Advantageously, it is possible to provide tubing 117*b* enabling this mixture to be directed in a vertical direction (or towards the well head). This tubing 117*b* penetrates into evacuation tubing 102 or stops before entering.

In addition, it is possible to install, at one end of tubing 117*b* or at opening 117*a*, a valve 119, for example a non-return valve, to limit or prevent the passage of liquid from inside the tank (104, 105) or from inside the evacuation tubing 102 to the annular area 107.

The first opening 117*a* is advantageously situated relatively high in the tank, but before the insulant 106. In fact, its high position enables the capacity of accumulation area 109 to be increased. Of course, if tubing 117*b* is installed on this opening, it is possible to increase the storage capacity of accumulation area 109 by placing the upper end of this tubing higher than the height of the first opening. In any event, one seeks to place the first opening 117*a* between the liquid accumulation area 109 and the connection to the evacuation tubing (represented by line 111).

A second opening 116*a* on the tank (for example, in extractable sub-part 105) may be provided to enable injection of gas (air, nitrogen or a gas that is neutral in relation to hydrocarbons or the gas present) from annular space 108 to the tank or more specifically to liquid accumulation area 109.

In addition, injection tubing 116*b* may be provided to be connected to this opening 116*a*. This tubing 116*b* may advantageously extend to the tank bottom, i.e., to the area close to bottom 118. A non-return valve 113 may be installed at one end of tubing 116*b* or at opening 116*a* or at any location on tubing 116*b*.

Advantageously, the first opening 117*a* (respectively the second opening 116*a*) is situated on the part of the extractable tank 105.

Evacuation tubing 102 may comprise gas injection valves or gas-lift valves (GLV) (114, 115) on its wall enabling a column of liquid rising in tubing 102 to be lightened, if necessary.

In the embodiment presented, well 112 is a deviated well. Of course, this embodiment also operates for a vertical well or a well comprising a horizontal or substantially horizontal part. The installation of such a device in a well comprising a horizontal area may prevent opening 117*a* from being situated too high (on the gravity, or vertical, axis) in relation to the well bottom while allowing the accumulation area 109 to be large. Preventing opening 117*a* from being too high in relation to the well bottom in fact limits production gas energy loss (and therefore its pressure) during entrainment of liquid into annular area 107: the higher this opening is situated in relation to the well bottom (or in relation to its lowest point), the more the production gas will have to provide energy to the suspended/entrained liquid in order to "compensate" for its potential energy and thus make it enter by opening 117*a*.

For example, length $L_R$ of tank bottom 118 at opening 117*a* (or at the upper end of tubing 117*b*) is advantageously greater than N times (N being a real number equal to or greater than 2) the height $H_R$ along the vertical (i.e. according to the gravity axis) between tank bottom 118 and opening 117*a* (or the upper end of tubing 117*b*).

Figure 1B:
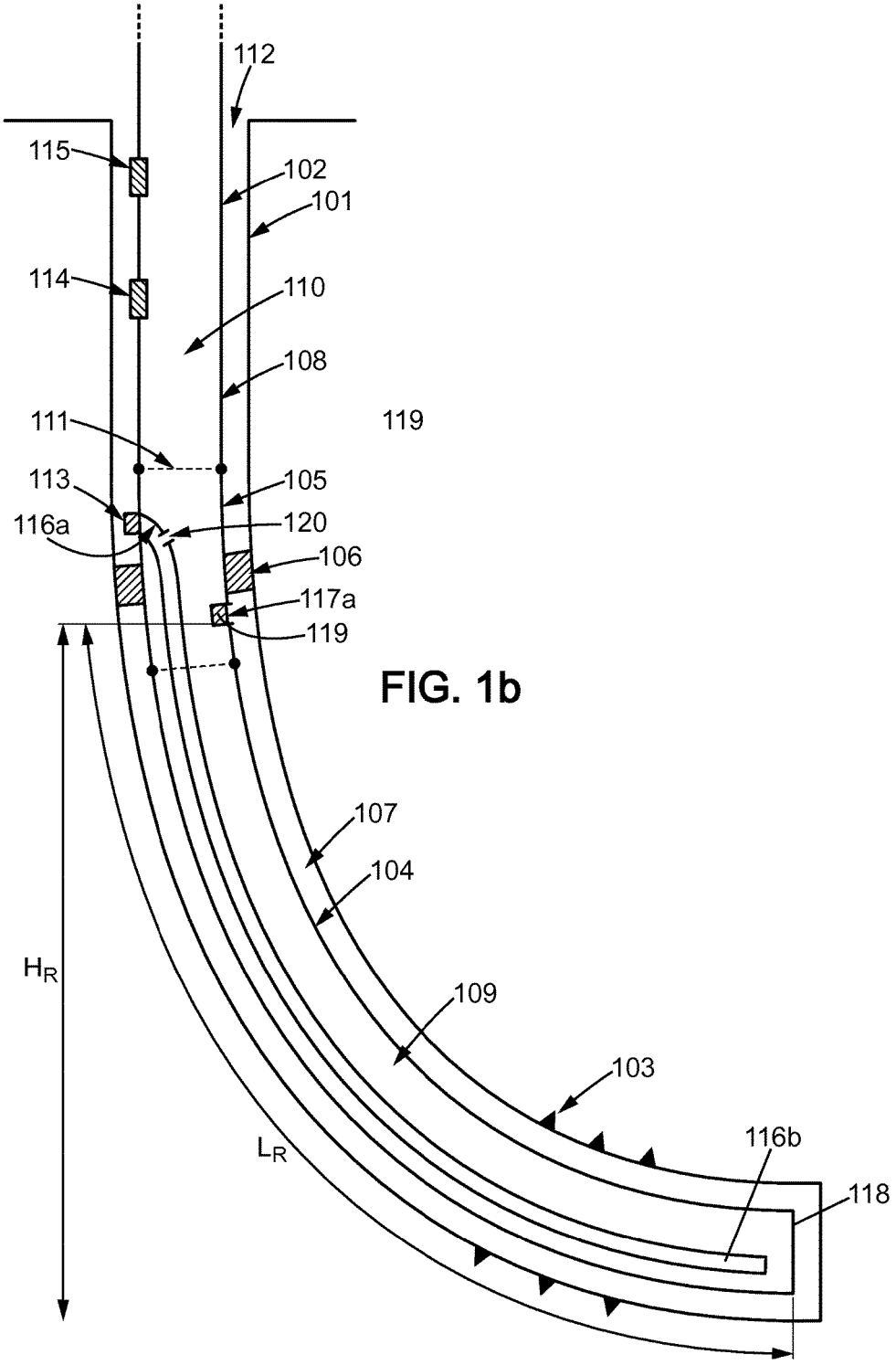

FIG. 1*b* illustrates another particular realization of the liquid accumulation and extraction device in a particular embodiment of the invention.

This embodiment includes essentially all of the characteristics of FIG. 1*a*, but certain differences are noted. Each of the differences presented below can be found separately in different embodiments.

In this embodiment, the non-return valve 113 may be installed at opening 116*a* as presented above.

Also, it is possible to provide a spill point (small-diameter calibrated orifice) 120 downstream from the non-return valve 113 on tubing 116*b* so that the gas trapped downstream from the valve, trapped in tubing 116*b*, can escape when the tank and first injection tubing are filled.

In addition, in this embodiment, the device does not comprise tubing 117*b*. The non-return valve 119 is assembled directly on opening 117*a*.

Advantageously, evacuation tubing 102 has a similar diameter to the tank. In fact, in the context of this invention, the size of the evacuation tubing does not have to be particularly reduced, in advance, to have flow speeds enabling good liquid lifting by gas. A large diameter may also present several advantages during the life of the well. First (before the device that is the object of this invention is used), a large diameter can avoid an important restriction to production, during the period when the well is capable of producing alone. Then, when the device is used, a large diameter can be more favorable to separation between gas and liquids.

Figure 2:
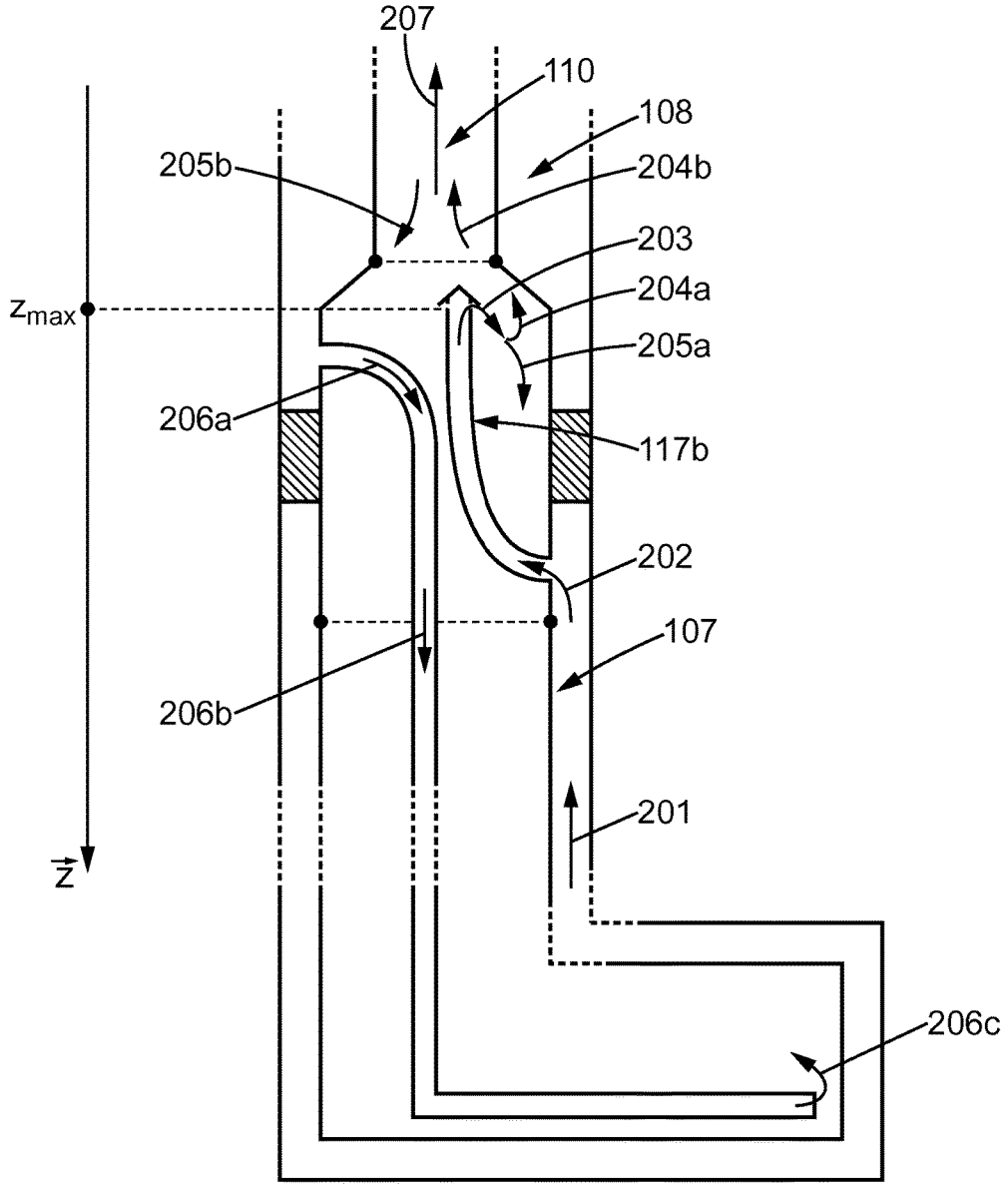
FIG. 2 illustrates different fluid circulations during operation in a particular embodiment of the invention.

FIG. 2 illustrates different fluid (liquids, gaseous, mixed) circulations during operation of the device in a particular embodiment of the invention.

These circulations visualize the operation of the device as described in relation to FIG. 1. Fig. references not mentioned in FIG. 2 or identical to FIG. 1 refer to the same elements or to similar elements in both FIGS. 1 and 2.

Once the production fluids have infiltrated into the well by completions 103 (and particularly into annular space 107), these fluids displace (arrow 201) along the tank installed in the well. In this area, the gas velocity is particularly increased due to narrowing of the space available at this level of the well: Flow acceleration promotes entrainment of liquids or other particles present at the well bottom in the annular space.

Due to the presence of insulant 106, the gas (or more specifically the mixture formed by the production gas and liquids) cannot circulate in the annular space above (according to the descending z axis) this insulant and then penetrate into the first opening (arrow 202).

Following the path of tubing 117*b*, the gas-liquid mixture is then distributed (arrow 203) in the tank. Of course, it is possible to distribute this gas-liquid mixture directly into evacuation tubing 102. The gas-liquid mixture can be directed in one vertical direction, but it can also be directed in another direction depending on the technical implementation options. For example, if the end of tubing 117*b* has a non-return valve, it may be appropriate to direct the gas-liquid mixture flow directly to the evacuation tubing. If the end of tubing 117*b* has a "conical hat" (as represented in FIG. 2, this conical hat prevents any flow of liquid flowing by gravity into tubing 117*b* from evacuation tubing 102), it may be appropriate to direct the gas-liquid mixture flow downward, i.e., towards the bottom of the tank.

In the case of FIG. 1*b* (i.e., in which there is no tubing 117*b*), the method is substantially the same. Due to gravity, the liquids contained in the mixture entering at input 117*a* will, at least partly, be directed to accumulation area 109, the gas itself naturally being driven upward.

A liquid-gas separation device may also be installed at the end of tubing 117*b* or on opening 117*a* (whether tubing 117 exists or not).

In any case, the liquid from the liquid-gas mixture tends to separate from the mixture (either by condensation or by simple gravity applied to droplets of liquid already present in the liquid). Because of this, at least part of the liquid can be directed towards the bottom of the tank (arrow 205*a*), to accumulation area 109.

Gas issued from this separation (which may still include part of the liquid) is directed (arrow 204*a*, 204*b*) to evacuation well 102 due to the natural pressure at the well bottom.

Of course, the liquid still present in the gas evacuated by the evacuation tubing can form on the walls of the evacuation tubing, by condensation for example, and slide along these walls (arrows 205*b*). The droplets of liquid can therefore displace by gravity towards the accumulation area. Advantageously, the section of the top end of tubing 117*b* is small (for ex., above a ratio of 2) in relation to the section of the evacuation tubing to limit the return of liquid into tubing 117*b*. In addition, it may be advantageous that projection on a horizontal plane of the section of tubing 117*b* does not intersect with the projection of the section of tubing 102 in the same plane: in particular, the liquid droplets sliding along the wall of tubing 102 cannot go back into tubing 117*b* by gravity.

The accumulation area fills with liquid as the fluids circulate as described above. Advantageously, this accumulation limits pressure losses particularly connected to the friction of liquids in/on the operating gas and to the vertical entrainment of liquids. In addition, the liquids present in the accumulation area do not exert back pressure that could limit or prohibit any infiltration of gas in the well.

Of course, the capacity of the accumulation area is not limitless. If it is possible to increase this capacity, particularly by increasing the length $L_R$ of the tank (while limiting, as far as possible, increasing the height $H_R$), there comes a time when the accumulation area is saturated (i.e., the surface of accumulated liquids is for example at height $z_{max}$) and the fluids thus accumulated need to be evacuated.

Thus, when an operator wishes to evacuate the liquids accumulated in the tank, he can put, from the surface, annular space 108 under pressure using a compressor (possibly shared between several wells). This pressurization enables the gas contained in the annular space to be injected at high velocity into tubing 116*b* through opening 116*a* (arrows 206*a* and 206*b*). When the gas exits tubing 116*b* (arrow 206*c*), the gas will push the liquids from accumulation area 109 vertically in the well into extraction tubing 102. The gas flow is sufficiently high that the liquids are "swept" (arrow 207) through evacuation tubing 102. If the pressure induced in accumulation area by this sudden injection of gas exceeds the production pressure at arrow 203, it is then advantageous to have a non-return valve, or check valve, at the end of tubing 117*b* or at opening 117*a* in order to block automatically the circulation of fluid towards annular space 107.

Figure 3:
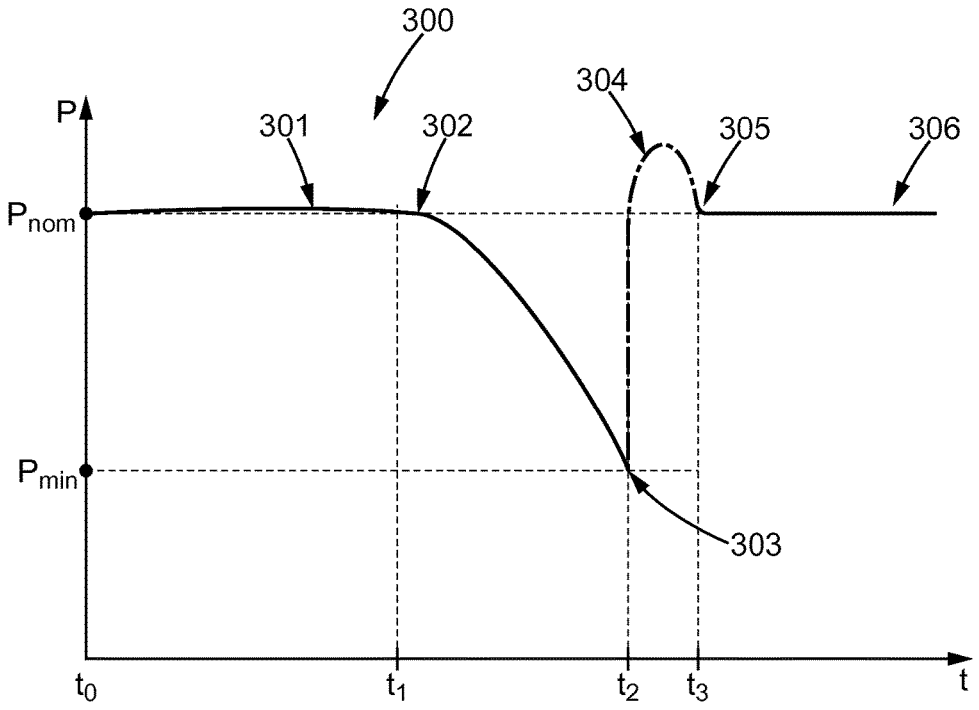
FIG. 3 illustrates a possible pressure curve during operation in a particular embodiment of the invention.

FIG. 3 illustrates a possible pressure curve 300 during operation in a particular embodiment of the invention.

This pressure curve can be established, in particular, by using sensors in the well, in evacuation well 102 for example. Advantageously, these sensors are situated at the well head, because it can be difficult to lower and permanently install sensors at a great depth.

During the accumulation area 109 filling phase, the pressure P at the sensors remains substantially constant (level part 301) equal to $P_{nom}$: In fact, liquids, which can reduce the production gas pressure, systematically accumulate in a "neutral" area, outside the gas circulation path (i.e., in accumulation area 109).

When the level of accumulated liquid exceeds height $z_{max}$, the pressure P starts to drop (between points 302 and 303), since the fluids then hinder the production gas circulation. It may happen that the gas circulation completely stops if the hydrostatic pressure of the liquid present above this height exceeds the gas pressure at the end of tubing 117*b* (a non-return valve positioned at this location then closes).

If a sudden drop in pressure P is detected from pressure $P_{nom}$, it is possible to infer that the accumulated liquids exceed height $z_{max}$. In addition, it may be desirable to wait until pressure P drops (point 303) below a predetermined value $P_{min}$ before taking any liquid evacuation action.

When it is decided that an accumulated liquid evacuation is desirable, gas can be suddenly injected into annular space 108 as described previously, in fact causing the expulsion of liquid out of the well via the evacuation tubing, thus reducing the quantity of accumulated liquid in the tank. This sudden gas injection causes a notable "erratic" variation in pressure (curve 304, for example).

Once this evacuation is performed (point 305), the production cycle starts again with a pressure stage 306 similar to stage 301.

This control of the liquid evacuation process can also be carried out using flow supervision and not pressure supervision.

In particular, when the gas flow lowers abnormally (i.e., below a given threshold value), this can mean that the level of liquid in the well is starting to surpass the point of entry of effluents into the device and thus begins to hydrostatically bear on the gas. Emptying the tank is then useful.

The end of the gas circulation to ensure emptying of the tank can be initiated when the liquid flow becomes low (or when the volume of liquid produced during the flushing corresponds to the volume of the accumulation area).

Of course, the present invention is not limited to the embodiments described above by way of example; the invention extends to other variants.

Other embodiments are possible.

For example, the embodiments described present tubing connected to openings in the tank, but other embodiments without the presence of this tubing can be contemplated.

The invention claimed is:

1. A liquid evacuation device capable of being positioned in an extraction well, the well comprising a well head and a well bottom, and in which the device comprises:

a tank comprising a plurality of walls and presenting a liquid accumulation area, said tank being able to be connected to a gas evacuation tubing positioned in the extraction well;

an insulant able to limit a flow of a fluid between a wall of the tank and a wall of the well, from a first space formed between the insulant and the well bottom to a second space formed between the insulant and the well head, said first space being located between the tank and the well, the walls of the tank being distinct from the wall of the well;

a first opening made on said tank enabling circulation of a gas-liquid mixture from said first space to a third space formed in the gas evacuation tubing;

a second opening on said tank enabling circulation of fluid from said second space to the liquid accumulation area; and in which said first opening is made between the liquid accumulation area and the connection to the evacuation tubing.

2. The device according to claim 1, in which the device is arranged to enable circulation of a liquid from said gas-liquid mixture from said third space to the liquid accumulation area.

3. The device according to claim 1, in which a first injection tubing is connected to the second opening for gas injection directed to an end of the accumulation area, this end being opposite in the well from the connection to the evacuation tubing.

4. The device according to claim 3, in which a second injection tubing is connected to the first opening for directed injection of the gas-liquid mixture to the inside of the connected evacuation tubing.

5. The device according to claim 4, in which a non-return device is disposed on the second injection tubing to limit the circulation of at least one liquid towards the first space.

6. The device according to claim 1, in which a non-return device is disposed on the first opening.

7. The device according to claim 1, in which at least one part of the tank is extractable through the inside of the connected gas evacuation tubing, said at least one extractable part comprising the first opening and the second opening.

8. The device according to claim 1, in which the tank comprises a horizontal sub-part.

9. The device according to claim 1, in which a length of a bottom of said tank at the first opening is over twice the height according to a gravity axis between said tank bottom and the first opening.

10. A method for evacuating liquid from an extraction well, the well comprising a well head and a well bottom, a tank presenting a liquid accumulation area, and a gas evacuation tubing connected to the tank; and an insulant limiting a flow of a fluid between a wall of the tank and a wall of the well, from a first space formed between the insulant and the well bottom to a second space formed between the insulant and the well head;

in which the method comprises:

circulating a gas-liquid mixture through a first opening made in said tank, the circulation of said mixture being done from said first space to a third space formed in the gas evacuation tubing, the first opening being made between the liquid accumulation area and the connection to the evacuation tubing;

separating, at least partial, of a liquid from said mixture in said gas evacuation tubing;

displacing of said separated liquid using gravitational force towards the liquid accumulation area;

injecting the fluid through a second opening in said tank from said second space to the liquid accumulation area, said injecting being capable of evacuating at least part of the liquid accumulated in the accumulation area via the evacuation tubing.

11. The method according to claim 10, in which injecting the fluid through a second opening is carried out upon detection of a drop in pressure in the gas evacuation tubing.

12. The method according to claim 10, in which injecting the fluid through a second opening is carried out upon detection of a drop in pressure in the gas evacuation tubing below a predetermined pressure.

* * * * *